United States Patent [19]

Ishihara

[11] Patent Number: 4,839,689

[45] Date of Patent: Jun. 13, 1989

[54] IMAGE FORMING APPARATUS

[75] Inventor: Shunichi Ishihara, Kanagawa, Japan

[73] Assignee: Canon Kabushiki Kaisha, Tokyo, Japan

[21] Appl. No.: 131,325

[22] Filed: Dec. 8, 1987

Related U.S. Application Data

[63] Continuation of Ser. No. 770,366, Aug. 29, 1985, abandoned, which is a continuation of Ser. No. 496,206, May 19, 1983, abandoned.

[30] Foreign Application Priority Data

May 24, 1982 [JP] Japan ..... 57-87713

[51] Int. Cl.[4] ..... G03G 15/08

[52] U.S. Cl. ..... 355/202; 346/153.1; 358/300; 355/261

[58] Field of Search ..... 355/3 R, 3 DD, 14 D; 346/153.1, 160; 358/300; 118/647, 648

[56] References Cited

U.S. PATENT DOCUMENTS

| | | | |
|---|---|---|---|
| 3,045,644 | 7/1962 | Schwertz | 355/4 X |
| 3,879,737 | 4/1975 | Lunde | 346/74 |
| 3,914,771 | 10/1975 | Lunde et al. | 346/74 |
| 3,946,402 | 3/1976 | Lunde | 346/74 |
| 4,174,903 | 11/1979 | Snelling | 355/3 DD X |
| 4,318,606 | 3/1982 | Buholtz et al. | 355/3 DD |
| 4,446,471 | 5/1984 | Yano | 355/3 TR X |

*Primary Examiner*—Fred L. Braun

*Attorney, Agent, or Firm*—Fitzpatrick, Cella, Harper & Scinto

[57] ABSTRACT

An image forming apparatus in which the electrostatic latent image formed on the latent image bearing member can be developed into an arbitrary state, or separate image information can be incorporated at the development of the latent image on the latent image bearing member. More specifically the latent image on the image bearing member is developed with electroconductive toner, in cooperation with electrically independent fine line-shaped developing electrodes supplied with determined bias voltages.

14 Claims, 3 Drawing Sheets

IMAGE FORMING APPARATUS

This application is a continuation of application Ser. No. 770,366 filed Aug. 29, 1985, now abandoned, which is a continuation of U.S. Ser. No. 496,206 filed May 19, 1983, now abandoned.

BACKGROUND OF THE INVENTION

1. Field of the Invention

The present invention relates to an image forming apparatus, and more particularly to an image forming apparatus in which an electrostatic latent image is formed on a latent image bearing member such as a photosensitive member with electroconductive toner.

2. Description of the Prior Art

Popularization of various image forming apparatus such as electrophotographic copiers and electrostatic recorders has induced a danger of illegal copying of private documents which the author does not wish to be copied, or official documents or banknotes.

A conventional countermeasure against such undesired copying consists of using, in the paper of the original document, watermarks or the like which do not appear or appear darker in the copy to facilitate the distinction of the copies from the originals. In such method, however, the paper to be used as the original is of a limited quality and is inevitably expensive. Besides such paper should not be easily available in order to prevent the use of such paper as the copying sheet.

Another countermeasure consists of marking an identification image in the copy of the original image. Such marking can be achieved by the use of plural exposure systems respectively for the original image and the identification image, or by conducting plural image forming cycles to superpose the identification image with the original image. In such method it is quite easy to form a black identification image in a white area of the copy or to form a white identification image in a black area of the copy. Such method is however not necessarily effective in case the original image does not have a determined pattern, since an identification image of a color which is the same as that of the copied image, or a white identification image on a white area is not easily recognizable.

SUMMARY OF THE INVENTION

An object of the present invention is to provide a novel developing apparatus for an electrostatic latent image.

Another object of the present invention is to provide an image forming apparatus capable of developing a synthesized image into a visible image or an arbitrary state according to the surface potential of the latent image bearing member.

Still another object of the present invention is to provide a developing apparatus capable of developing a latent image on a latent image bearing member in plural modes.

Still another object of the present invention is to provide an image forming apparatus capable of developing a latent image formed on an electrophotographic photosensitive member selectively in plural modes.

Still another object of the present invention is to provide an image forming apparatus capable of recording additional information, different from the latent image formed on an electrophotographic photosensitive member, on said photosensitive member, and simultaneously transferring said latent image and said additional information onto a transfer sheet.

The foregoing objects can be achieved according to the present invention by an image forming apparatus comprising a latent image bearing member, means for forming an electrostatic latent image on said latent image bearing member, and means for developing the latent image formed on said image bearing member, wherein said developing means utilizes electroconductive toner and is provided with mutually electrically insulated developing electrodes which are arranged across the developing width of said image bearing member and which are selectively supplied with determined bias voltages.

The bias voltages supplied to the developing electrodes of said developing means allow development of the latent image on said image bearing member in an arbitrary state, namely as a negative or positive image, or to differentiate the amount of toner deposition between the latent image area and the background area. Also selective voltage supply to said electrodes allows the inscription of additional information while developing the latent image on the latent image bearing member.

DETAILED DESCRIPTION OF THE PREFERRED EMBODIMENTS

Figure 1:
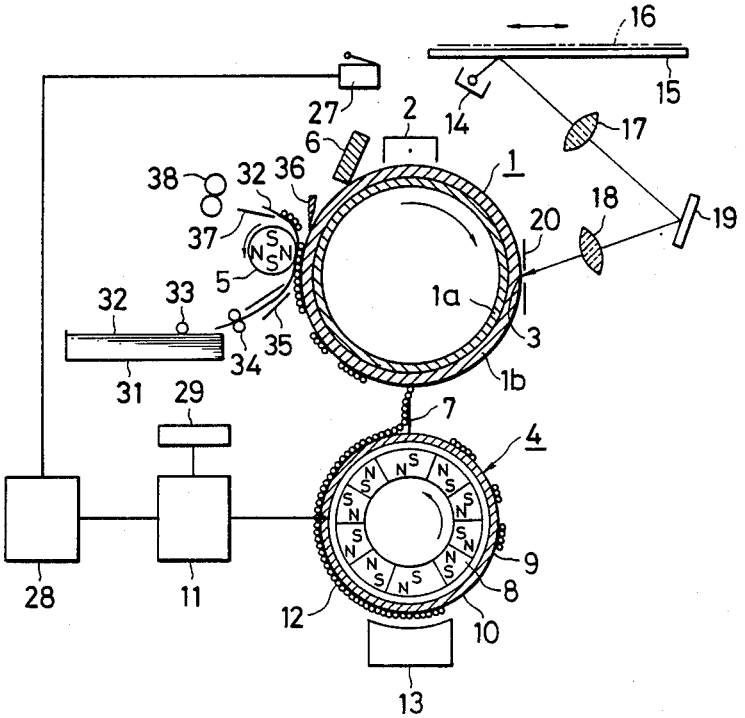
FIG. 1 is a schematic view of an embodiment of the image forming apparatus of the present invention.

Now the present invention will be explained in detail referring to the embodiments shown in the attached drawings. Referring to FIG. 1, a drum-shaped photosensitive member 1 functioning as the image bearing member and rotated in a direction indicated by the arrow is composed of an aluminum drum-shaped substrate 1*a* and a photoconductive layer 1*b* such as selenium formed thereon. Along the periphery of said photosensitive member there are provided, in succession in the direction of rotation, a corona charger 2, an optical image exposure station 3, a developing unit 4, a transfer roller 5 and a cleaning unit 6 as imaging process stations.

Said developing unit 4 utilizes a needle electrode array 7, and is provided with a rotary magnet member 8 having N and S poles alternately along the periphery thereof, and encircled, with a space from said magnet poles, by an aluminum pipe 9 of a thickness of about 5 mm functioning as a toner transporting member. Said aluminum pipe 9 is surficially subjected to almite treatment for forming an insulating layer 10. In the above-described arrangement the rotary magnet member 8 alone rotates while the aluminum pipe 9 is fixed to the not-shown body of the apparatus.

Said needle electrode array 7 is composed of a linear array of iron needles of about 50 microns in thickness and about 5 mm in length, which are planted in the axial direction of said metal pipe 9 and are provided respectively with mutually insulated lead wires (not shown), formed by suitable metal plating and etching on said insulating layer 10 and connected to an identification signal generator 11 incorporating a memory. Such needle electrode array 7 is already disclosed in the U.S. Pat. Nos. 3,914,771, 3,879,737, 3,946,402 etc. and can be applied in the forms as described in said patents.

The developer employable in this invention is magnetically permeable and electroconductive one-component toner, for example toner 881 type supplied by Sumitomo 3M Co., Ltd. Said toner 12 is supplied, under the magnetic effect of the rotary magnet member 8 driven in the direction indicated by the arrow, from a toner reservoir 13 to the front end of the needle electrode array 7 through the periphery of the metal pipe 9, and forms chain beads between the needle electrode array 1 and the photosensitive member 1.

The surface of the photosensitive member 1 is subjected, in the course of rotation thereof, at first to uniform charging to +600 V by the corona charger 2, and is then exposed, in the exposure station 3, through an optical system composed of lenses 17, 18 and a mirror 19 and through a slit 20, to the reflected image of an original document 16 placed on a carriage 15 and illuminated by a halogen lamp 14, thereby forming an electrostatic latent image corresponding to said original.

Figure 2:
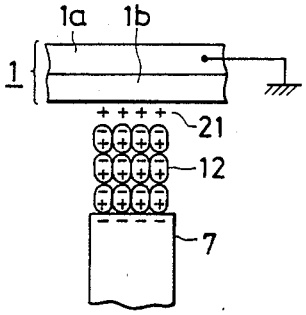
FIG. 2 is a schematic view of the developing process.
Figure 3:
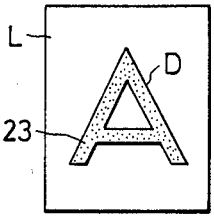
FIG. 3 is a plan view of the photosensitive member after positive development according to the process shown in FIG. 2.

Subsequently said electrostatic latent image is rendered visible in the developing unit 4, wherein, as shown in FIG. 2, the needle electrode array 7 and the substrate 1*a* of the photosensitive member are maintained at the ground potential. Corresponding to a charged area 21 of the electrostatic latent image on the photosensitive member 1, there is induced a charge in the toner 12 to generate a Coulomb force, whereby the toner particles which have overcome the magnetic attractive force of the rotary magnet member 8 are deposited to the surface of the photosensitive member to achieve development of the electrostatic latent image. On the other hand, in an uncharged area of the electrostatic latent image such toner deposition onto the photosensitive member does not take place because the above-mentioned Coulomb force is not generated due to the lack of charge induction in the toner 12. In this manner the toner is deposited on the electrostatic latent image formed on the photosensitive member, thus achieving image development corresponding to the original image.

The toner image thus obtained on the photosensitive member is a positive image 23 to the original image, wherein the toner deposition takes place only in the dark area D but not in the light area L.

Figure 6:
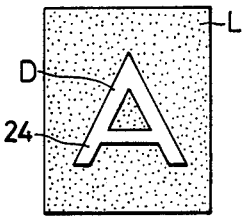
FIG. 6 is a plan view of the photosensitive member after negative development according to the process shown in FIGS. 4 and 5.

Then, in case a voltage of a polarity which is the same as that of the electrostatic latent image, for example a voltage in the order of +100 V, with respect to the ground potential of the substrate 1*a* of the photosensitive member, is supplied from a power source E to the needle electrode array 7, the toner 12 being in contact with the photosensitive member is positively charged by charge injection through said array 7. Consequently the toner 12 is not deposited, by the repulsive force of the positive charge thereof, in the positively charged area 21 of the electrostatic latent image on the photosensitive member 1, and moves from the needle electrode array 7 on the toner being adhered to the downstream side of the metal pipe 9 by the attraction of the rotary magnet member 8. On the other hand, in the uncharged area of the electrostatic latent image on the photosensitive member 1, in response to the voltage supply to the needle electrode array 7 as mentioned above, a negative charge 22 is induced in the substrate 1*a* through the photoconductive layer 1*b* by the positive charge of the toner 12 to generate a Coulomb force between the photosensitive member and the toner, whereby the toner particles which have overcome the magnetic attractive force of the rotary magnet member are deposited on the photosensitive member. Consequently obtained is a negative image 24 as shown in FIG. 6, wherein the toner deposition is exclusive in the area D of the electrostatic latent image corresponding to the dark image area of the original 16.

Figure 7:
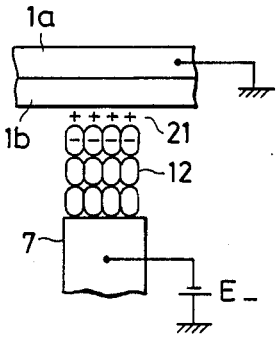
FIGS. 7 and 8 are schematic views of the developing process with a voltage, opposite to that shown in FIG. 4, supplied to the developing electrode.
Figure 8:
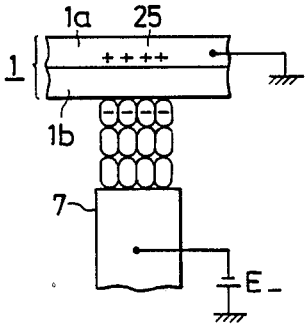
Figure 9:
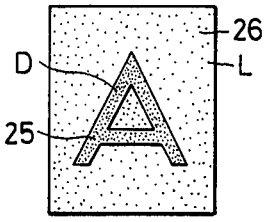
FIG. 9 is a plan view of the photosensitive member after positive development according to the process shown in FIGS. 7 and 8.

Then, in case a voltage of a polarity opposite to that of the electrostatic latent image, for example a voltage in the order of −100 V is supplied from a power source −E to the needle electrode array 7, the toner being in contact with the photosensitive member is positively charged. Consequently, in the positively charged area 21 of the photosensitive member 1, as shown in FIG. 7, the toner 12 is deposited with a stronger Coulomb force than in the ordinary image development, with a larger amount than in the aforementioned case in which the needle electrode array 7 is maintained at the ground potential. On the other hand, in the uncharged area of the photosensitive member 1, as shown in FIG. 8, a positive charge 25 is induced in the substrate 1*a* through the photoconductive layer 1*b* by the negative charge of the toner 12 to generate a Coulomb force between the photosensitive member and the toner, whereby the toner is deposited under the influence of said Coulomb force. Consequently, as shown in FIG. 9, a toner image 25 is obtained in the image area D corresponding to the dark image area of the original 16, with a higher density than in the case of maintaining the needle electrode array 7 at the ground potential, while the non-image background area L corresponding to the non-image light area of the original is also developed with the toner deposited by the Coulomb force.

In this manner the development can be controlled by varying the potential supplied to the needle electrode array 7. More specifically, a positive latent image can be developed as a positive image or a negative image, or as a positive image with background fog, according to the potential supplied to said needle electrode array 7. Consequently a single latent image can be rendered visible in three manners. It is therefore possible, even in an apparatus designed for forming a positive latent image, to achieve positive and negative modes by the voltage supplied to the needle electrode array. This phenomenon allows recordation of separate information onto the photosensitive member, regardless of the presence or absence of or the polarity of the electrostatic latent image on said photosensitive member.

More specifically, the electrodes employed in the developing unit of the present invention are mutually electrically insulated, and can therefore be utilized for recording additional information, regardless of the presence or absence of the latent image, by suitable selection of the polarity of the signal voltages supplied to the electrodes of the developing unit in consideration of the surface potential of the photosensitive member.

Figure 10:
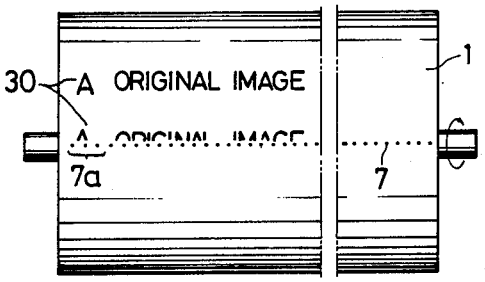
FIG. 10 is a front view of the photosensitive member showing an example of the identification image.

Now reference is made to FIG. 10 showing an example of recording additional information onto the photosensitive member.

Figure 4:
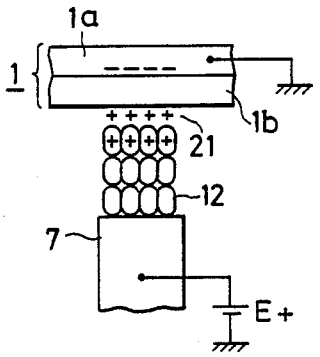
FIGS. 4 and 5 are schematic views of the developing process with a voltage supplied to the developing electrode.
Figure 5:
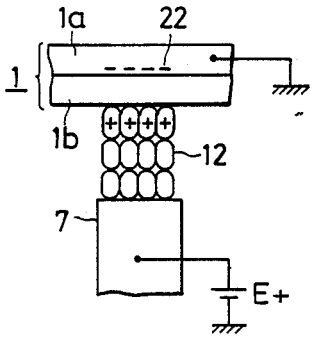

As shown in FIG. 10, additional image information can be obtained as a toner image on the surface of the photosensitive where no latent image exists using development shown in FIG. 4, while the electrostatic latent image on the photosensitive member 1 is developed with a first electrode portion of the needle electrode array 7 maintained at the ground potential, by supplying identification image signals from an identification image signal generator 11 to a second electrode portion forming another part of the needle electrode array 7, or, in the illustrated example, to a left-end part *7a* of said array 7. Such recording of additional image information with the needle electrode array can be achieved by determining the timing of the voltages supplied to particular ones of the needle electrodes in synchronization with the peripheral speed of the photosensitive member.

In case the position of the additional identification image 30 coincides with the charged area of the photosensitive member corresponding to a dark area of the original, the needle electrode array 7 can be supplied with a voltage of polarity which is the same as that of the electrostatic latent image to obtain the identification image 30 in the negative form as shown in FIG. 6, or with a voltage of a polarity opposite to that of the electrostatic latent image to obtain said identification image 30 with a higher density than that of the image obtained from said electrostatic latent image, as shown in FIG. 9. Also in case the position of the additional identification 30 coincides with the uncharged area of the photosensitive member corresponding to a light area of the original, the needle electrode array 7 can be supplied with a voltage of a polarity which is the same as that of the electrostatic latent image, whereby the additional image can be formed, with the same toner density as that of other image areas, on the photosensitive member. Also in case of recording the additional image 30 in the light area of the photosensitive member, a voltage of a polarity opposite to that of the latent image in the dark area may be supplied to obtain said additional image with a lower density on the photosensitive member.

Said identification image 30 can be recorded constantly in a determined position, for example in the leading end portion or trailing end portion of the copied image, by closing a switch 27 provided in the moving path of the original carriage 15 as shown in FIG. 1 to activate a timer 28, and by thus triggering the aforementioned identification image signal generator 11 over a determined period.

Also an arbitrary identification image 30 may be entered from input means 29 such as a keyboard to said identification image signal generator 11, whereby corresponding signals are supplied from a memory therein to the needle electrode array 7 to record such identification image on the photosensitive member in the aforementioned manner. It is therefore possible to select, by the information entered from said input means, the image information previously stored in said memory. It is also possible to enter image information from the input means to said memory and to record such image information when needed.

In the apparatus shown in FIG. 1, a transfer sheet 32 is supplied, from a cassette 31, by a feeding roller 33, paired timing rollers 34 and guide plates 35 to a position between the photosensitive member 1 and the image transfer unit 5, whereby the toner image formed on the photosensitive member 1 in the above-described manner is transferred onto the transfer sheet 32 by means of the transfer roller 5. After said image transfer, the transfer sheet 32 is separated from the photosensitive member 1 by a separating member 36, then is transferred through a guide plate 37 to paired fixing rollers 38 for fixing said toner image onto the transfer sheet, and finally ejected from the apparatus.

In the foregoing embodiment, in an image forming apparatus in which the image of an original formed electrophotographically on an image bearing member is developed with electroconductive toner supplied through a needle electrode array, the recording of an additional identification image, for facilitating the recognition that the obtained image is a copy, can be easily achieved by supplying the voltages corresponding to said identification image to said needle electrode array thereby forming said identification image in an arbitrary manner on said image bearing member. Said identification image may be determined for each address of the copy in order to facilitate the handling of the documents. Also the polarity of the voltage supplied to said needle electrode array may be suitably selected, for example by means of a switch, to record a colored identification image in a white background area of the original, or to record said identification image in negative form or with a higher density in a black area of the original, thereby facilitating the recognition of said identification image.

Figure 11:
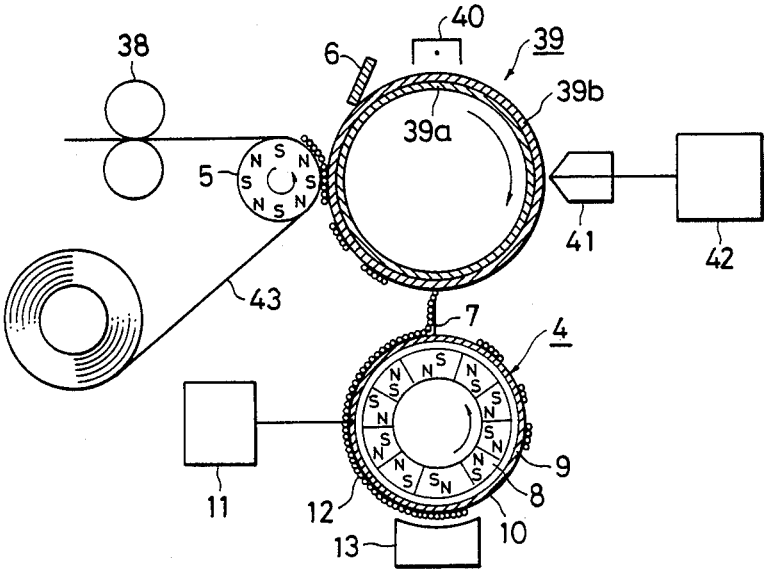
FIG. 11 is a schematic view of a facsimile apparatus embodying the present invention.

The present invention is not necessarily limited to the electrophotographic copier shown in FIG. 1 but is also applicable to other recording apparatus such as a facsimile apparatus as shown schematically in FIG. 11, wherein components of the same functions as explained before are represented by the same numbers.

In FIG. 11, there are shown an insulating drum 39 composed of an aluminum substrate **39*a* and a surficial insulating layer 39*b*; a corona discharger 40 for charging or discharging said drum 39 to a uniform potential; and a conventional multistylus electrode array 41 for receiving image signals from a signal source 42 in response to the reception signals, thereby affecting imagewise charge elimination or charging of the insulating drum 39 to form a charge image thereon. The latent image thus formed is developed by the above-described developing unit 4, and other information such as the time of reception is simultaneously obtained as a toner image in response to the signals supplied to said developing unit from the image signal generator 11. The synthesized image on the drum 39 is then transferred onto a transfer sheet 43** in a roll form and used after image fixation.

Figure 12:
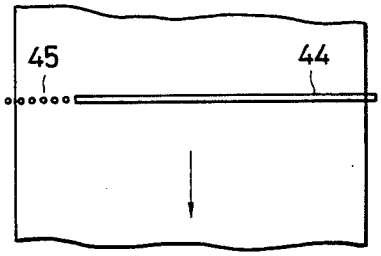
FIG. 12 is a schematic view showing another embodiment of the electrodes of the developing apparatus.

The latent image bearing member employable in the present invention is not limited to a member having a photosensitive layer but includes any member provided with a charge retaining ability and capable of forming an electrostatic charge image thereon. Also the developing electrodes may be composed of mutually insulated needle electrodes over the entire developing width of the latent image bearing member as explained in the foregoing, but, in case the position of the additional information is limited, may be composed, as shown in FIG. 12, of mutually independent electrodes 45 forming the second electrode portion in the position of said additional information and of a continuous electrode 44 forming the first electrode portion in the remaining area where said electrode is simply used for the development of the latent image.

Furthermore, said latent image bearing member need not be of drum shape but can be of web shape. Also the developing electrodes employed in the developing unit 4 need not be of needle shape but may be of any structure in which the neighboring electrodes are mutually electrically insulated and in which the electrodes can be simultaneously or selectively supplied with voltages of a determined polarity and can satisfactorily guide the toner particles. The transportation of electroconductive toner to the developing electrodes is generally achieved by the use of magnetic toner and under the influence of a magnetic field as already explained in relation to FIG. 1.

The latent image formed on said latent image bearing member is limited to positive but may also be negative, and such negative latent image can again be developed into a positive image by suitable selection of the voltage supplied to the above-mentioned developing electrodes. In such case, said image and an additional image can be obtained in positive form by supplying a voltage of a polarity which is the same as that of the background potential. Naturally the image development in various modes is possible by suitably selecting the voltage to be supplied to the developing electrodes, in consideration of the polarity and the negative or positive state of the latent image.

What is claimed is:

1. An image forming apparatus comprising:

(a) a latent image bearing member;

(b) means for forming an electrostatic latent image on said latent image bearing member;

(c) means for developing the latent image formed on said latent image bearing member, wherein said developing means comprises:

(i) developing electrodes which are mutually electrically independent between neighbouring electrodes and arranged in the widthwise direction of said latent image bearing member and adapted to receive image signal voltages of the same polarity as said electrostatic latent image;

(ii) means for supplying an electrically conductive and magnetic toner to said developing electrodes, wherein said toner is selectively deposited on said latent image bearing member in accordance with a potential of said latent image and signal voltages supplied to said developing electrodes, and wherein said toner at the undeveloped latent image portion resists the charge applied to the toner by said electrodes and the latent potential, and the toner at the developing portion deposited on said image bearing member corresponding to the image signal voltage is charged by said electrodes and the latent potential.

2. An image forming apparatus according to claim 1, wherein said latent image bearing member is a photosensitive member, said electrostatic latent image forming means has optical means for irradiating an image information beam onto the latent image bearing member, and an electrostatic latent image is formed on said latent image bearing member by the irradiation of the image information beam thereonto.

3. An image forming apparatus according to claim 1, wherein said latent image bearing member is an insulating member, said electrostatic latent image forming means has recording electrode means, and the recording signal is supplied to the recording electrode means to thereby form an electrostatic latent image on said latent image bearing member.

4. An image forming apparatus according to claim 1, wherein said image signal is biased on said developing electrodes.

5. An image forming apparatus comprising:

(a) a latent image bearing member;

(b) means for forming an electrostatic latent image on said latent image bearing member; and (c) developing means comprising:

(i) first electrode portion for developing said electrostatic latent image, said electrode portion being disposed in series in the widthwise direction of said latent image bearing member;

(ii) second electrode portion for recording specific information on said latent image bearing member, said second electrode portion being aligned in the width direction of said latent image bearing member and including mutually electrically independent neighbouring electrodes, and signal voltages corresponding to the specific information being supplied to said second electrode portion; and (iii) means for supplying electrically conductive and magnetic toner to said first and second electrode portions, wherein said first and second electrodes generate a charge at said toner for developing said electrostatic image.

6. An image forming apparatus comprising:

(a) a latent image bearing member;

(b) means for forming an electrostatic latent image on said latent image bearing member;

(c) means for developing the latent image formed on said latent image bearing member, wherein said developing means comprises:

(i) developing electrodes which are mutually electrically independent between neighbouring electrodes and arranged in the widthwise direction of said latent image bearing member and adapted to receive image signal voltages of a polarity opposite that of said electrostatic latent image;

(ii) means for supplying electrically conductive and magnetic toner to said developing electrodes, wherein said toner is selectively deposited on said latent image bearing member in accordance with a potential of said latent image and signal voltages supplied to said developing electrodes, and wherein said toner is at the latent image portion developed on the latent image of the image bearing member by the image signal applied to the toner by said electrodes, and said toner at the non-latent image portion developed on said image bearing member by an image signal voltage applied to said toner by an amount smaller than that applied to the latent image portion to be developed.

7. An image forming apparatus according to claim 6, wherein said latent image bearing member is a photosensitive member, said electrostatic latent image forming means has optical means for irradiating an image information beam onto the latent image bearing member, and an electrostatic latent image is formed on said latent image bearing member by the irradiation of the image information beam thereonto.

8. An image forming apparatus according to claim 6, wherein said latent image bearing member is an insulating member, said electrostatic latent image forming means has recording electrode means, and the recording signal is supplied to the recording electrode means to thereby form an electrostatic latent image on said latent image bearing member.

9. An image forming apparatus to claim 6, wherein said image signal is biased on said developing electrodes.

10. An image forming apparatus comprising:

(a) a latent image bearing member;

(b) means for forming an electrostatic latent image on said latent image bearing member;

(c) means for developing the latent image formed on said latent image bearing member, wherein said developing means comprises:

(i) developing electrodes which are mutually electrically independent between neighbouring electrodes and arranged in the widthwise direction of said latent image bearing member and adapted to receive image signal voltages of the same potential as a substrate of said latent image bearing member;

(ii) means for supplying electrically conductive and magnetic toner to said developing electrodes, wherein said toner is selectively deposited on said latent image bearing member in accordance with a potential of said latent image and signal voltages supplied to said developing electrodes, and wherein the deposition of said toner on said image bearing member is due to a reversed polarity voltage of the latent image and is applied to said developing electrodes.

11. An image forming apparatus according to claim 10, wherein said apparatus has transferring means for transferring a toner image on the latent image bearing member onto a transfer material, said toner has magnetism, and said transferring means transfers said toner onto a transfer material by action of the magnetic field.

12. An image forming apparatus comprising:

(a) a latent image bearing member;

(b) means for forming an electrostatic latent image on said latent image bearing member;

(c) means for developing the latent image formed on said latent image bearing member, wherein said developing means comprises:

(i) developing electrodes which are mutually electrically independent between neighbouring electrodes and arranged in the widthwise direction of said latent image bearing member and adapted to receive image signal voltages switchable to have the same polarity as, or the opposite polarity to, said electrostatic latent image, wherein conductive toner is supplied between said developing electrodes and said image bearing member; and (ii) means for supplying electrically conductive and magnetic toner to said developing electrodes, wherein said toner is selectively deposited on said latent image bearing member in accordance with a potential of said latent image and signal voltages supplied to said developing electrodes, and wherein said supplying means has the same polarity as, or the opposite polarity to, said electrostatic latent image.

13. An image forming apparatus according to claim 12, wherein said latent image bearing member is a photosensitive member, said electrostatic latent image forming means has optical means for irradiating an image information beam onto the latent image bearing member, and an electrostatic latent image is formed on said latent image bearing member by the irradiation of the image information beam thereonto.

14. An image forming apparatus according to claim 12, wherein said latent image bearing member is an insulating member, said electrostatic latent image forming means has recording electrode means, and the recording signal is supplied to the recording electrode means to thereby form an electrostatic latent image on said latent image bearing member.

* * * * *

UNITED STATES PATENT AND TRADEMARK OFFICE

CERTIFICATE OF CORRECTION

PATENT NO. : 4,839,689

DATED : June 13, 1989

INVENTOR(S) : SHUNICHI ISHIHARA

It is certified that error appears in the above-identified patent and that said Letters Patent is hereby corrected as shown below:

COLUMN 3

Line 30, "array 1" should read --array 7--.

COLUMN 4

Line 23, "exclusive" should read --exclusively--.

COLUMN 5

Line 12, "photosensitive" should read --photosensitive member--.
Line 38, "30" should read --image 30--.

COLUMN 7

Line 22, "is limited" should read --is not limited--.
Line 47, "image;" should read --image; and--.

COLUMN 8

Line 48, "image;" should read --image; and--.
Line 59, "developed" should read --is developed--.

UNITED STATES PATENT AND TRADEMARK OFFICE

CERTIFICATE OF CORRECTION

PATENT NO. : 4,839,689

DATED : June 13, 1989

INVENTOR(S) : SHUNICHI ISHIHARA

It is certified that error appears in the above-identified patent and that said Letters Patent is hereby corrected as shown below:

COLUMN 9

Line 12, "apparatus to" should read --apparatus according to--.

Line 29, "member;" should read --member; and--.

Signed and Sealed this

First Day of October, 1991

*Attest:*

*Attesting Officer*

HARRY F. MANBECK, JR.

*Commissioner of Patents and Trademarks*